United States Patent [19]

Kramer et al.

[11] 4,006,958

[45] Feb. 8, 1977

[54] RIGHT ANGLE ELECTRICAL PLUG

[75] Inventors: David E. Kramer; Russell F. Stoll, both of Northbrook, Ill.

[73] Assignee: Daniel Woodhead, Inc., Northbrook, Ill.

[22] Filed: Feb. 21, 1975

[21] Appl. No.: 551,785

[52] U.S. Cl. ..... 339/110 P; 339/196 A

[51] Int. Cl.[2] ..... H01R 13/58

[58] Field of Search ..... 339/196, 206, 103, 107, 339/110

[56] References Cited

UNITED STATES PATENTS

| | | | |
|---|---|---|---|
| 3,718,890 | 2/1973 | Sheldon | 339/196 A |
| 3,784,961 | 1/1974 | Gartland, Jr. | 339/107 |
| 3,787,798 | 1/1974 | Carissimi et al. | 339/196 M |
| 3,808,583 | 4/1974 | Liberman | 339/196 A |
| 3,856,376 | 12/1974 | Poliak et al. | 339/107 |

*Primary Examiner*—W. Tupman
*Assistant Examiner*—Neil Abrams
*Attorney, Agent, or Firm*—Johnson, Dienner, Emrich & Wagner

[57] ABSTRACT

A right angle electrical plug is disclosed comprising a housing having a generally right angle configuration and formed with first and second hollow leg members. A plurality of inserts are assembled in the housing and secured in assembled relation without the use of any insert assembly screws, one of the inserts having the contact blades extending therefrom and there being only two screws necessary to hold the entire assembly together. Finger grip means such as oppositely extending flanges on said housing, are provided to be grasped by the fingers to facilitate removal of the plug from an electrical receptacle. The entire plug is formed of an insulating material such as a suitable plastic.

10 Claims, 5 Drawing Figures

RIGHT ANGLE ELECTRICAL PLUG

BACKGROUND OF THE INVENTION

Right angle electrical plugs have been known heretofore wherein the contact blades extend therefrom in one direction while the current carrying conductors extend therefrom in a direction at substantially ninety degrees with respect to said blades. Difficulties have been encountered in removing such plugs from an electrical receptacle, particularly where there is a tight fit between the blades and the receptacle.

Although it is not good practice to do so, a person often will remove a conventional plug from a receptacle by pulling outwardly on the cable containing the conductors, but this is not possible with a right angle plug, and it therefore becomes necessary to grasp the body of the plug to remove it.

The surface of the plug body normally is smooth and therefore, particularly in the event of a tight fit, the fingers will slip thereby making it difficult or impossible to remove the plug without the use of some tool or device.

In the present invention this difficulty has been overcome by providing the plug with finger grips, thereby enabling the plug body to be grasped and removed from a receptacle with ease.

Also, right angle plugs heretofore known have had to be assembled by the use of assembly screws for each individual part plus additional screws to hold the assembled parts together. This is time consuming and therefore costly, and this disadvantage has been overcome in the present invention by assembling together individual inserts within a housing wherein all of the parts are secured by the use of only two screws.

In view of the foregoing, therefore, it is a principal object of the present invention to provide a right angle electrical plug which overcomes the aforementioned disadvantages and which may be made more economically than heretofore.

Another object is to provide a right angle electrical plug wherein the body or housing thereof is provided with suitable finger grips to facilitate removal thereof from an electrical receptacle.

A further object is to provide the body of an electrical plug with outwardly extending flange portions on opposite sides thereof which may be grasped by the fingers to facilitate removal thereof from an electrical receptacle.

A still further object is to provide a right angle plug which is formed of a housing having hollow leg portions at substantially right angles to each other and within which the various parts of the plug may be assembled and then secured in place by using a maximum of two screws.

Other objects and advantages of the invention will become apparent upon a reading of the following specification taken in conjunction with the accompanying drawings.

DETAILED DESCRIPTION OF THE INVENTION

Figures 1, 2, 3:
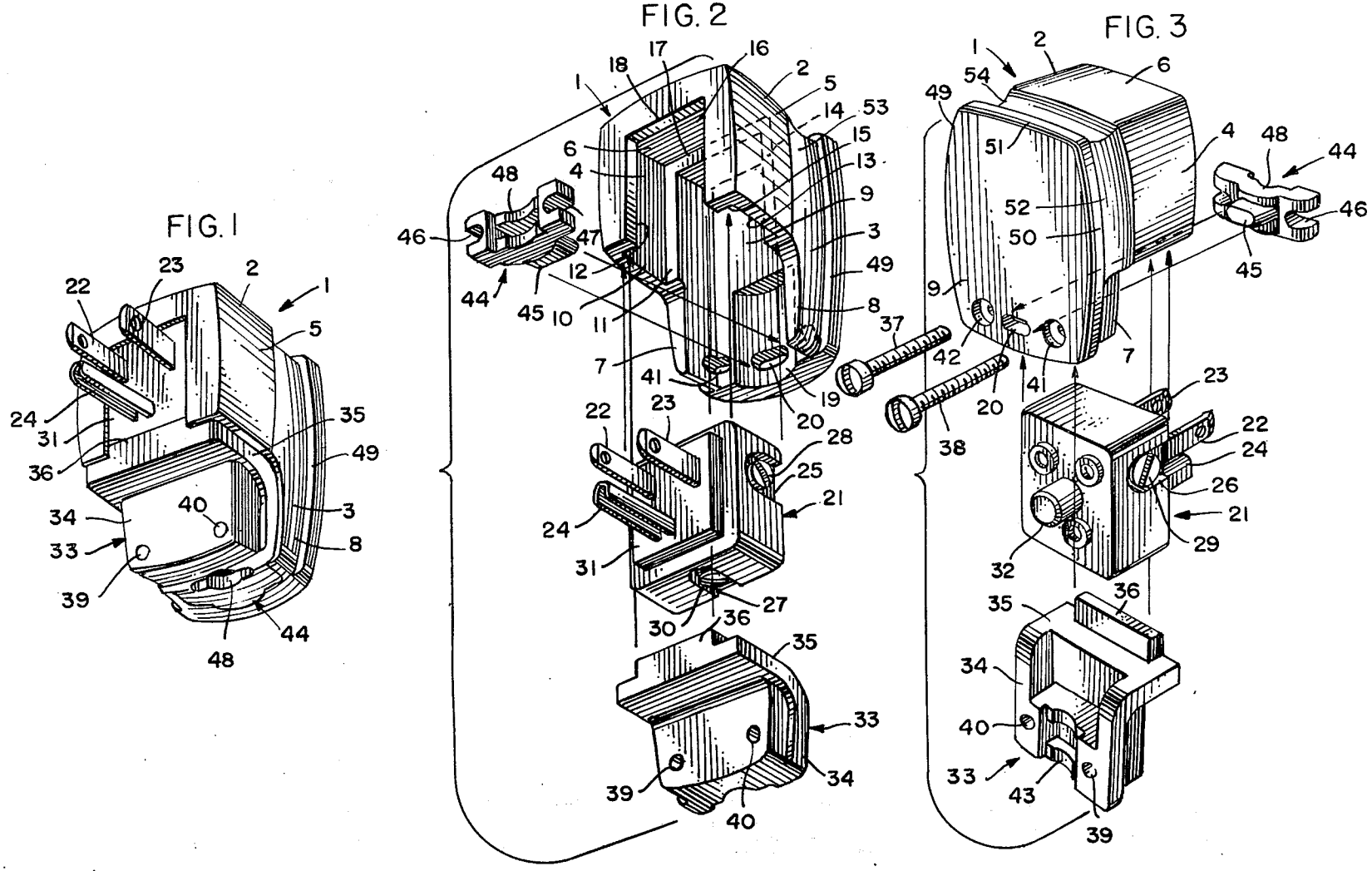
FIG. 1 is a front perspective view of an assembled right angle electrical plug embodying the present invention.
FIG. 2 is an exploded view in perspective showing each of the elements of the plug of the present invention, looking toward the front thereof.
FIG. 3 is a view similar to FIG. 2 but looking toward the rear of the plug.

Referring now to the drawings and more particularly to FIGS. 1, 2 and 3 thereof it will be seen that the plug of the present invention is provided with a substantially right angled housing member generally indicated by the numeral 1. This housing has a first or horizontal leg portion 2 and a second or vertical leg portion 3. This first leg portion 2 is provided with the spaced side walls 4 and 5 and a top wall 6.

The second or vertical leg portion is provided with the spaced side walls 7 and 8 and a third wall 9 which closes the back of the hollow L shaped housing. The inner surface of each of these wall portions is recessed as may be seen in FIG. 2 wherein the recess on the inner surface of the side wall 4 is indicated by the numeral 10. This recess has the shoulder 11 at the rear thereof and another shoulder 12 at the front thereof. The opposite wall 5 of the housing has a similar recess in the inner surface thereof which is indicated by the numeral 13. This recess is provided with the shoulder 14 at the rear thereof and a similar shoulder 15 at the front.

The top wall 6 on the inner surface thereof is also provided with a similar recess which connects with the recesses in the side walls. The recess in the top wall is indicated by the numeral 16 and is provided with similar shoulders 17 at the rear thereof and 18 at the front thereof. As will appear more fully hereinafter these recesses 10, 13 and 16 receive one of the inserts which make up the assembly.

The inner surface of the second leg portion 3 is provided with a recess which has preferably an arcuate contour and is indicated by the numeral 19. The lower part of this recess 19 is provided with an opening 20 therethrough and this recess and opening has a purpose which will appear more fully hereinafter.

A first, or contact carrying insert, generally indicated by the numeral 21, is provided with the contact blades 22 and 23 and the ground blade 24 extending outwardly therefrom. Opposed sides of this insert 21 are provided with the recesses 25 and 26 respectively and the underside thereof has a similar recess 27. Recess 25 receives the screw 28 which threadedly engages the contact blade 23 to which an electrical conductor may be connected. Similarly the recess 26 receives the screw 29 whereby an electrical conductor may be connected therethrough to the blade 22. The recess 27 receives the screw 30 for securing and connecting a conductor to the ground for blade 24.

The insert 21 is provided on the outer surface thereof with a rectangular offset portion 31. The rear face of the insert 21 is provided with a rearwardly extending protrusion 32 which serves a purpose which will be more fully described hereinafter.

It will be noted that the first insert 21 is received within the first or horizontal leg 2 of the housing and within the recesses on the inner walls thereof, and the assembled appearance is that shown in FIG. 1. The front shoulders of the recesses overlie the insert 21 and prevent removal thereof except downwardly and outwardly of the various recesses.

There is then provided a second insert, indicated generally by the numeral 33, which is generally L shaped and has a vertical leg 34 and a horizontal leg 35. The leg 35 at the outer end thereof is provided with a short vertical wall 36 extending upwardly therefrom, and when this second insert 33 is assembled with the first insert 21 in the housing it will noted that the rear face of this wall 36 will abut or overlie the lower edge of the first insert 21 immediately below the rectangular offset area 31 on the front of the insert.

This second insert 33 is secured in place in the housing in assembled relation with the other parts thereof by means of the screws 37 and 38 which are received in the openings 41 and 42 in the back of the housing and then extend through the openings 39 and 40 in the insert which may be threaded to engage the threads on the screws.

In assembling these various parts the first insert 21 will be received within the housing by sliding it along the recesses 10 and 13 on the inner surfaces of the housing walls. The width of each recess 10, 13 and 16 will be substantially equal to the depth of the first insert 21 so that the offset portion 31 will be received between the front shoulder portions of each recess. The rearwardly extending protrusion 32 is received within a shallow recess 32*a* in the inner face of the wall 9 as an aid to properly locating the insert 21. The second insert may then be assembled and held in place with the screws 37 and 38, but suitable electrical conductors will first be connected to the respective contact and ground blades through the screws 28, 29 and 30, as heretofore described. The rear face of the second insert 33 is provided with an arcuate recess 43 as may be clearly seen in FIG. 3. This arcuate recess opposes the arcuate recess 19 on the inner surface of the rear wall 9 and provides an opening, when in assembled relation therewith, for the reception of the cable with the electrical conductors therein.

Figure 5:
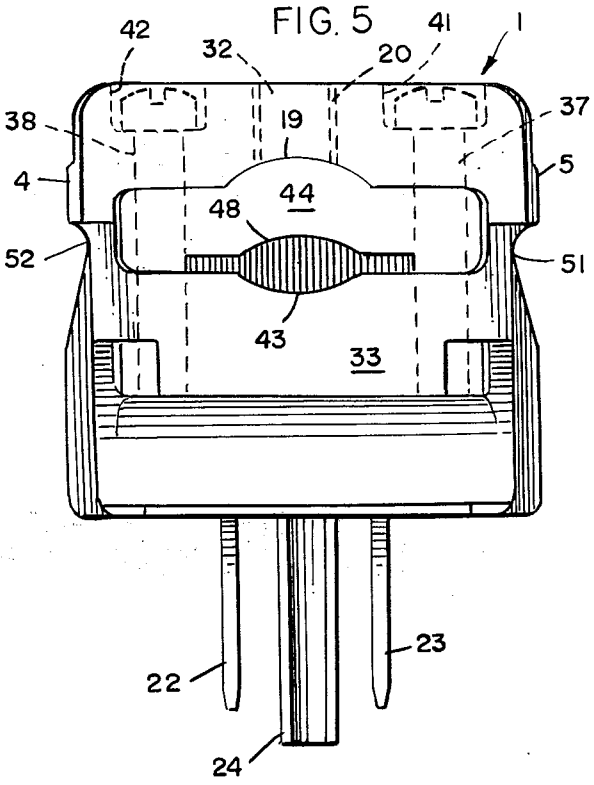
FIG. 5 is a bottom plan view of the plug shown in FIG. 1.
Figure 4:
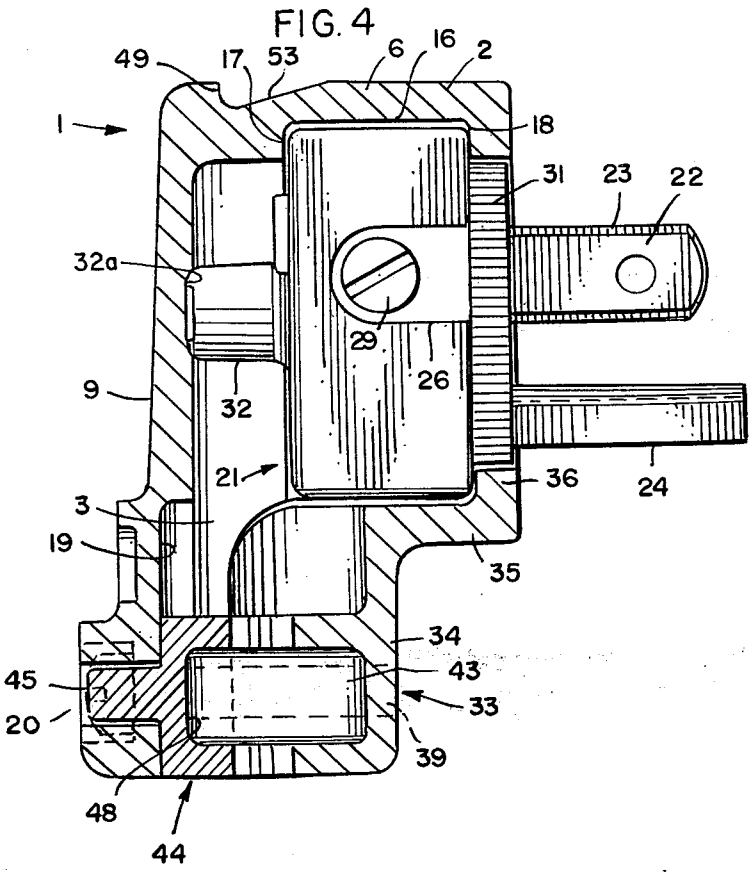
FIG. 4 is an enlarged vertical sectional view taken through the plug of the present invention from the front to the rear thereof and with the parts in assembled relation as shown in FIG. 1.

Depending upon the purpose for which this plug is to be used the cable may be relatively heavy and of large diameter or relatively light and of smaller diameter. The assembly just described is adapted for use with a relatively large cable but when a smaller cable is to be used the assembly is provided with a third insert, generally indicated by the numeral 44, which makes the opening smaller in which the cable is to be received. As may be more clearly seen in FIGS. 2 and 3 this insert 44 is provided on its rear face with a rearwardly extending lug 45 adapted to be received within the opening 20 in the rear wall of the housing. Recesses 46 and 47 are provided at each end of the insert 44 so that when it is assembled within the housing the elongated screws 37 and 38 may extend therethrough. Between these end portions the front part of the insert is arcuately recessed as at 48. Thus, after the first insert 21 has been assembled within the housing, and the cable to be used is of a relatively small diameter, the insert 44 may be placed within the housing so that the lug 45 extends through the opening 20 therein, and thereafter the insert 33 is assembled therewith. The recess 43 in the face of the insert 33 will then oppose the recess 48 on the insert 44 to provide a smaller opening, as may be seen in FIG. 1 for example. This relationship may also be seen more clearly in FIGS. 4 and 5.

One of the primary features of the present invention involves the provision of the finger grips as mentioned heretofore, for the purpose of facilitating removal of the plug from an electrical receptacle. In this connection the wall 9, which forms a closure for the housing, may be provided at least on the opposite sides thereof with flange members such as those shown at 49 and 50. If desired, a similar flange 51 may be provided along the upper edge of the wall 9. The elongated concave portions 52, 53 and 54 adjacent each of the respective finger grips 50, 49 and 51, facilitate the grasping of the flanges for removal of the plug from an electrical receptacle.

A further feature and advantage resides in the fact that the offset portion 31 on the front face of the contact carrying insert 21 is rectangular, thereby enabling such insert to be received within the housing and secured in any one of four positions 90° apart by the overlapping flanges of the main body, without the use of assembly screws through the insert. The contact insert is completely isolated by, and enclosed in, insulating plastic material and the terminations cannot be disturbed without removing the two clamp screws.

Furthermore the assembly lends itself to being made from a transparent plastic material, resulting in easy viewing of the terminations.

From the foregoing description it will be evident that, by the invention disclosed herein, there is provided a right angle electrical plug of simplified construction, which may be assembled easily and quickly. Furthermore, the provision of the finger grips facilitate considerably the manipulating of the plug, particularly for the removal thereof from an electrical receptacle, and the assembly time is considerably less than in other similar plugs heretofore known, due to the use of only the two clamp screws to lock the entire assembly together.

Changes may be made in the form, construction, and arrangements of parts from those disclosed herein without in any way departing from the spirit of the invention or sacrificing any of the attendant advantages thereof, provided, however, that such changes fall within the scope of the claims appended hereto.

We claim:

1. A right angle electrical plug comprising:

a. a housing having first and second leg portions forming a generally right angle configuration, b. a first insert member having electrical contact blades thereon adapted to have electrical conductors connected thereto and removably received within that portion of the housing forming the first leg portion thereof so that said blades thereon extend outwardly therefrom to be inserted into an electrical receptacle, c. a second insert member removably received in that portion of the housing forming the second leg portion thereof, d. cooperating interengaging parts on said first and second insert members so arranged that said first insert member cannot be removed while said second insert member is in place, said first insert member being otherwise readily removable, e. means to secure said second insert member in said housing to prevent removal of both of said inserts, and f. an opening between the second leg portion of said housing and said second insert member for receiving a cable having electrical conductors therein for connection with said contact blades.

2. A right angle electrical plug as defined in claim 1, combined with finger grip means on the face of said housing opposite the side thereof from which said blades extend, adapted to be grasped by the fingers to facilitate removal of said plug from a receptacle.

3. A right angle electrical plug as defined in claim 2, wherein said finger grip means comprises flange members extending beyond the body of said housing on opposed edges of said face.

4. A right angle electrical plug as defined in claim 1, combined with a third insert member removably mounted on said second leg portion in association with said opening and adapted to make said opening smaller, when said insert is present, and to make said opening larger, when said insert is removed.

5. A right angle electrical plug as defined in claim 4, wherein said opening is formed by cooperating recesses in said second insert and said third insert.

6. A right angle electrical plug as defined in claim 1, combined with retaining means on that portion of the housing forming the first leg portion, in overlapping relation with said first insert member, thereby to prevent inadvertent removal thereof from said housing.

7. A right angle electrical plug as defined in claim 6, wherein said interengaging parts include retaining means on said second insert member in overlapping relation with said first insert member, thereby to aid in preventing inadvertent removal of said first insert member from said housing.

8. A right angle electrical plug as defined in claim 1, wherein said interengaging parts include retaining means on said second insert member in overlapping relation with said first insert member, thereby to aid in preventing inadvertent removal of said first insert member from said housing.

9. A right angle electrical plug as defined in claim 1, wherein said opening is formed by cooperating recesses in said second leg portion and said second insert.

10. A right angle electrical plug as defined in claim 1, wherein said first insert member is substantially rectangular, thereby enabling it to be received and secured within said housing in any one of four different positions.

* * * * *